US007238012B2

(12) United States Patent
Morita

(10) Patent No.: US 7,238,012 B2
(45) Date of Patent: Jul. 3, 2007

(54) ROTARY PUMP

(76) Inventor: Kazuo Morita, c/o Nakakin Co., Ltd. of 1-21, Kikawahigashi 4-chome, Yodogawa-ku, Osaka-shi, Osaka (JP)

( * ) Notice: Subject to any disclaimer, the term of this patent is extended or adjusted under 35 U.S.C. 154(b) by 981 days.

(21) Appl. No.: 10/054,755

(22) Filed: Nov. 12, 2001

(65) Prior Publication Data

US 2005/0214154 A1 Sep. 29, 2005

Related U.S. Application Data

(62) Division of application No. 09/539,533, filed on Mar. 31, 2000, now Pat. No. 6,328,547.

(30) Foreign Application Priority Data

Aug. 4, 1999 (JP) ..... H11-101634
Aug. 4, 1999 (JP) ..... H11-101635
Aug. 4, 1999 (JP) ..... H11-101636

(51) Int. Cl.
*F03C 2/00* (2006.01)
*F04C 2/00* (2006.01)

(52) U.S. Cl. ..... 418/133; 418/134; 418/206.1

(58) Field of Classification Search ..... 418/130–134, 418/171, 166, 206.1; 91/533; 92/13.8, 13.7
See application file for complete search history.

(56) References Cited

U.S. PATENT DOCUMENTS 1,694,805 A * 12/1928 Sumner ..... 418/134
2,038,090 A * 4/1936 Smith ..... 92/13.7
2,210,152 A * 8/1940 Sacha ..... 418/134
2,635,552 A * 4/1953 Dale et al. ..... 418/69
2,909,124 A * 10/1959 Maisch ..... 418/70
5,120,206 A * 6/1992 Greenstreet et al. ..... 418/206.7
6,808,374 B2 * 10/2004 Phallen et al. ..... 418/132

* cited by examiner

*Primary Examiner*—Theresa Trieu
(74) *Attorney, Agent, or Firm*—Goodwin Procter LLP; Richard I. Samuel; Fujikawa & Co.

(57) ABSTRACT

A rotary pump has a simple construction by omitting a transmission shaft on the side of a motor and whereby makes a cost of the rotary pump as low as possible, with maintaining feature that assembling and disassembling is facilitated. The rotary pump has a main casing, a casing cover cooperated with the main casing for defining a pumping chamber therebetween, a pair of rotors received within the pumping chamber with mutually meshing pumping segments for synchronous revolution in mutually opposite directions, a space being defined in one portion of the casing cover, a cover piston being disposed within the space for movement back and forth with respect to an end surface of the rotor, and an air cylinder being mounted on the casing cover and having a piston rod, to which the cover piston is connected.

2 Claims, 10 Drawing Sheets

ROTARY PUMP

This is a divisional application of application Ser. No. 09/539,533, filed on Mar. 31, 2000, now U.S. Pat. No. 6,328,547.

FIELD OF THE INVENTION

The present invention relates to a rotary pump suitable for transporting liquid foods.

BACKGROUND

The most recent prior art in connection with rotary pumps is disclosed in commonly owned U.S. Pat. No. 5,370,514, to Morita et al.

The prior art structure is discussed hereinafter in detail to facilitate clear understanding of the improvements of the present invention.

FIGS. 10 and 11 show the commonly owned prior art. In these drawings, rotors 1A and 1B from a short rotor shaft 2 is provided from the central portion of one end surface thereof. A threaded bore 3 is coaxially formed from the end surface of the rotor shaft 2. A pumping segment 4 is integrally formed on the outer peripheral portion of each rotor 1A and 1B.

A pump casing 6 includes a main casing defining a concave 25 pumping chamber 7 loosely accommodating the pumping segments 4 or revolution therein and formed with a suction port 8 and a discharge port 9, and a casing cover 11 detachably attached on a main casing 10 flush with the end surface of each rotor 1A and 1B by bolts and nuts.

Hollow rotor drive shafts 12A and 12B are provided corresponding to the rotors 1A and 1B. The rotor drive shaft 12 is supported by a bearing 14 within a gearbox 13 for the drive shaft, for rotation and for restricting movement in an axial direction. A rotor fastening bolt 15 is inserted through a hollow portion of each of the hollow rotor drive shafts 12A and 12B from one end to the other end. A bolt head 15*a* of the rotor fastening bolt 15 is engaged with one end surface of the rotor fastening bolt 15.

A hollow portion 16*a* at the tip end of each rotor drive shaft 12A and 12B is externally engaged with the rotor shaft 2 of each rotor 1A and 1B.

In conjunction therewith, a threaded portion 15*b* at the tip end of the rotor fastening bolt 15 is threadingly engaged with the threaded bore 3 of the rotor shaft 2.

A gearbox 17 for a transmission shaft is shown in FIG. 11. A transmission shaft 21 is rotatably supported in bearings 18 and 19 within the gearbox 17, and is connected to a motor (not shown). A gear 22 is mounted on the transmission shaft 21. In the gearbox 13 for the drive shaft, gears 23*a* and 23*b* are mounted for transmitting rotation to drive a pair of rotor drive shafts 12A and 12B in mutually opposite directions in synchronism with each other and a gear 23*c* is provided meshing with the gear 22 mounted on the transmission shaft 21. Accordingly, a driving force of the motor to be transmitted to the transmission shaft 21 is transmitted to one rotor shaft 12A through the gears 22 and 23*c*. The driving force of the rotor drive shaft 12A is transmitted to the other rotor drive shaft 12B through the gears 23*a* and 23*b*.

For assembling the rotary pump constructed as set forth above, the pumping segment 4 of each rotor 1A and 1B is received within the pumping chamber 7 of the main casing 10. In conjunction therewith, each rotor shaft 2 is engaged with the hollow portion 16*a* at the tip end of the hollow rotor drive shaft 12 supported within the gearbox 13. Then, the rotor fastening bolt 15 is inserted within the rotor drive shaft 12 from one end to threadingly engage the threaded portion 15*b* at the tip end thereof with the threaded bore 3 of the rotor shaft 2. Then, the bolt head 15*a* is rotated by a rotary tool, such as spanner or the like for tightening to draw each rotor 1A and 1B toward the rotor drive shaft 12 for fixed fastening.

In the rotary pump assembled as set forth above, a rotational torque of the not shown motor is transmitted to the transmission shaft 21. Both of the rotor drive shafts 12 driven to rotate through the transmission shaft 21 drive to rotate both rotors 1A and 1B in mutually opposite directions in synchronism with respect to each other as shown by arrows in FIG. 11. Thus, by action of the pumping segments 4 rotated within the pumping chambers 7, liquid is sucked into the pumping chamber 7 through the suction port 8 and is pressurized and fed to the discharge port 9. In this case, overall inner side surface of the casing cover 11 is a flat surface in flush with the external end surface of the rotors 1A and 1B not to form a recessed portion between the rotors 1A and 1B. Therefore, there will be no retention of the transported liquid flowing through the pumping chamber 7. Accordingly, washing of the pumping chamber can be easily performed.

On the other hand, upon disassembling the rotors 1A and 1B, nuts 20 are loosened to remove the casing cover 11, and thereafter, the rotors I A and 1B are easily disassembled by simply loosening the rotor fastening bolts 15.

As is clear from the construction, in the prior art, the gearbox 17 for the transmission shaft 21 is provided separately from the gearbox 13 of the drive shaft, and driving force has to be transmitted to the rotor drive shaft 12 through the gear mounted on the transmission shaft 21 on the side of the motor and the gear 23*a* housed within the gearbox 13 for the drive shaft.

Conventionally, there are required in addition to a pair of rotor drive shafts 12A and 12B for driving the rotor as set forth above, the transmission shaft 21 for transmitting the rotational torque of the motor to the rotor drive shafts 12A and 12B, a total of at least three shafts in total. Therefore, the construction is inherently complicate.

On the other hand, as can be clear from the construction set forth above, in the recent prior art, the rotor fastening bolt 15 inserted into the hollow portion of the hollow rotor drive shaft 12 is rotated by rotating the bolt head 15 at the rear end with the rotary tool so that the threaded portion 15*b* at the tip is threadingly engaged with the rotor 1A(1B) to draw the rotor 11A backward by the rotor fastening bolt 15 and to abut the bolt head 15*a* onto the end surface of the hollow rotor drive shaft 12. On the other hand, upon disassembly, the rotors 1A and 1B can be disassembled easily only by loosening the rotor fastening bolt 15 by rotatingly operating the bolt head 15*a*. Also, the mating surfaces of the rotor 1A(1B) and opposing casing cover 11 may be formed flush. Coupling between the rotor 1A(1B) and the hollow rotor drive shaft 12A(12B) is effected by externally engaging the tip end of the drive shaft and by maintaining external engagement by drawing force applied by tightening the rotor fastening bolt 15 into the rotor shaft 12. Therefore, the force of the connection between them is insufficient. Also, centering of the rotor 1A(1B) and the hollow rotor drive shaft 12A(12B) cannot be complete thereby to cause possible center vibration.

Furthermore, as shown in FIGS. 10 and 11, the conventional rotary pump defines the pumping chamber 7 with the main casing 10 and the casing cover 11 mounted thereon. A pair of rotors 1A and 1B are housed within the pumping chamber 7. The end surface 1*a* of the casing cover 111 of each of rotors 1A and 1B are placed in substantially contacting state with a minimum fine gap required for permitting rotation of the rotors 1A and 1B. Both rotors 1A and 1B are synchronously rotated in mutually opposite directions by mutually engaging the pumping segments 4 of the rotors 1A and 1B by the rotor drive shafts 12 as shown by the arrows of FIG. 11. Thus, the liquid is sucked into the pumping chamber 7 through the suction port 8, and pressurized and fed to the discharge port 9. In this case, a gap between the end surface 1*a* of each rotor 1A and 1B and the inner surface 11*a* of the casing cover 11 mating thereto are substantially in contact with a minimal fine gap for permitting rotation of the rotor 1A and 1B. The ability to flow of the liquid in this fine gap is quite low. Accordingly, even when washing liquid is circulated within the pumping chamber at the end of workday, the washing liquid does not flow sufficiently between both surfaces 11*a* and 1*a*. Therefore, a sufficient washing effect cannot be achieved.

SUMMARY OF THE INVENTION

The present invention has been developed in view of the problems set forth above. Therefore, it is the first object of the present invention to construct a rotary pump with simple construction by omitting a transmission shaft on the side of a motor and thereby to make a cost of the rotary pump as low as possible, while maintaining ease of assembling and disassembling.

Another object of the present invention is to enhance the fastening force between the rotary drive shaft and the rotor and assure centering therebetween not to cause center vibration even under long term use.

Yet another object of the present invention is to achieve satisfactory washing effect by flowing sufficient amount of washing liquid through a gap between an end surface of a rotor and an inner end surface of a casing cover opposing thereto.

According to a first aspect of the present invention, the rotary pump comprises:

a pair of rotors having pumping segments mutually engaged with each other for synchronous revolution in mutually opposite directions within a pump casing;

a pair of hollow rotor drive shafts supported in gearboxes adjacent the pump casing for integral rotation with said pair of rotors; and a pair of rotor fastening bolts inserted into hollow portions of respective hollow rotor drive shafts to attach the pair of rotors and the pair of hollow rotor drive shafts on the outer end surfaces of the rotor drive shaft under tension.

Respective ones of the hollow rotor drive shafts being synchronously rotated in mutually opposite direction with meshing with synchronous driving gears provided in respective gearboxes, one of the hollow rotor drive shaft extends outwardly from the gearbox to form an extended drive shaft portion, a cylindrical frame shaped transmission coupling having an operating space for operating the rotor fastening bolt being coupled with the extended drive shaft portion for integral rotation.

According to a second aspect of the present invention the rotary pump comprises:

a pair of rotors having pumping segments mutually engaged with each other for synchronous revolution in mutually opposite direction within a pump casing;

a pair of hollow rotor drive shafts supported in gearboxes adjacent the pump casing for integral rotation with a pair of the rotors; and a pair of rotor fastening bolts inserted into hollow portions of respective hollow rotor drive shafts to fix the pair of rotors and the pair of hollow rotor drive shafts on the outer end surfaces of the rotor drive shaft under tension, respective ones of the hollow rotor drive shafts being synchronously rotated in mutually opposite direction and meshing with synchronous driving gears provided in respective gearboxes, the rotors and the hollow rotor drive shafts being connected by splined couplings for integral rotation, the rotor fastening bolts being inserted through the hollow rotor drive shafts through the rotors from the side of the casing cover, and a flange provided on a end portion of the rotor fastening bolt being engaged within a recessed portion on the end surface of the rotor on the side of the casing cover.

According to a third aspect of the present invention, the rotary pump comprises:

a pair of rotors having pumping segments mutually engaged with each other for synchronous revolution in mutually opposite direction within a pump casing;

a pair of hollow rotor drive shafts supported in gearboxes adjacent the pump casing for integral rotation with a pair of the rotors; and a pair of rotor fastening bolts inserted into hollow portions of respective hollow rotor drive shafts to fix the pair of rotors and the pair of hollow rotor drive shafts on the outer end surfaces of the rotor drive shaft under tension, respective of the hollow rotor drive shafts being synchronously rotated in mutually opposite direction and meshing with synchronous driving gears provided in respective gearboxes, the rotor and the hollow rotor drive shaft being connected by splined coupling for integral rotation, the rotor fastening bolts being integrally formed with the rotors, and the rotor fastening bolts being inserted into the hollow rotor driven shafts.

According to a fourth aspect of the present invention, the rotary pump comprises:

a main casing;

a casing cover cooperating with the main casing for defining a pumping chamber therebetween;

a pair of rotors in the pumping chamber with mutually meshing pumping segments for synchronous revolution in mutually opposite directions;

a space in one portion of the casing cover;

a cover piston disposed within the space for movement back and forth with respect to an end surface of the rotor;

an air cylinder being mounted on the casing cover and having a piston rod, to which the cover piston is connected.

According to a fifth aspect of the present invention, the rotary pump comprises:

a main casing;

a casing cover cooperating with the main casing for defining a pumping chamber therebetween;

a pair of rotors in the pumping chamber with mutually meshing pumping segments for synchronous revolution in mutually opposite directions;

a space being defined in one portion of the casing cover; a cover piston being disposed within the space for movement back and forth with respect to an end surface of the rotor; a lock cylinder having a lock bolt being mounted on the casing cover for restricting movement of the cover piston by means of the lock bolt.

According to a fifth aspect of the present invention, the rotary pump comprises:

a main casing;

a casing cover cooperating with the main casing for defining a pumping chamber therebetween;

a pair of rotors in the pumping chamber with mutually meshing pumping segments for synchronous revolution in mutually opposite directions;

a space in one portion of the casing cover; a cover piston in the space for movement back and forth with respect to an end surface of the rotor; an air cylinder mounted on the casing cover and having a piston rod; a lock cylinder having a lock bolt being mounted on the air cylinder; the cover piston being connected to a piston rod projected from one end surface of the piston of the air cylinder; a piston rod projecting from the other end surface of the piston of the air cylinder abutted to the lock bolt for restricting movement of the cover piston by means of the lock bolt.

According to a sixth aspect of the present invention, the rotary pump comprises:

a main casing;

a casing cover cooperating with the main casing and defining a pumping chamber therebetween;

a pair of rotors received within the pumping chamber with mutually meshing pumping segments for synchronous revolution in mutually opposite directions;

a space in one portion of the casing cover;

a cover piston in the space for movement back and forth with respect to an end surface of the rotor;

a plurality of air cylinders mounted on the casing cover wherein piston rods thereof are connected with each other, and the cover piston is connected to a piston rod and having a piston rod, to which the cover piston is connected.

According to a seventh aspect of the present invention, the rotary pump comprises:

a main casing;

a casing cover cooperating with the main casing and defining a pumping chamber therebetween;

a pair of rotors within the pumping chamber with mutually meshing pumping segments for synchronous revolution in mutually opposite directions; a space in one portion of the casing cover;

a cover piston in the space for movement back and forth with respect to an end surface of the rotor;

a plurality of air cylinders mounted on the casing cover wherein piston rods thereof are connected with each other, and the cover piston is connected to a piston rod and having a piston rod, to which the cover piston is connected; a lock bolt coaxially provided on the air cylinder at the rearmost position, and the cover piston being connected to the piston rod of the air cylinder at its front most side;

a piston or a piston rod of the air cylinder at the rearmost position being in contact with the lock bolt for restricting movement of the cover piston by the lock bolt.

BRIEF DESCRIPTION OF THE DRAWINGS

The present invention will be understood more fully from the detailed description given hereinafter with reference to the accompanying drawing of a suitable embodiment of the present invention, which, however, should not be taken to be limitative to the present invention, but is for explanation and understanding only.

In the drawings.

DETAILED DESCRIPTION

In the following description, numerous specific details are set forth to provide a thorough understanding of the present invention. It will be clear, however, to those skilled in the art that the present invention can be practiced without many of these specific details. In other instances, well-known structural components are not shown in detail to avoid unnecessarily complicating the description.

Figure 1:
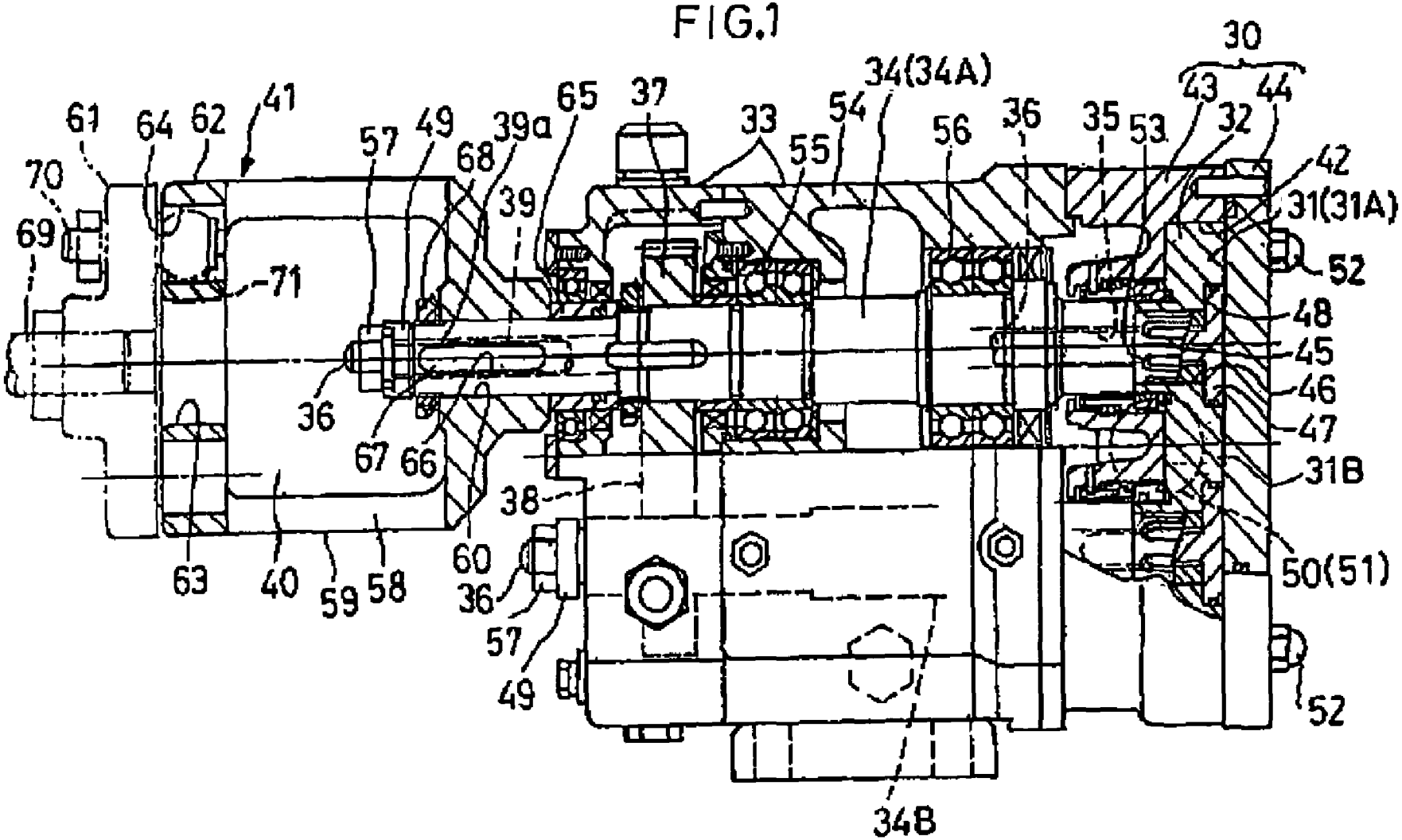
FIG. 1 is a front elevation in partial cross-section of one embodiment of a rotary pump according to the present invention.
Figure 10:
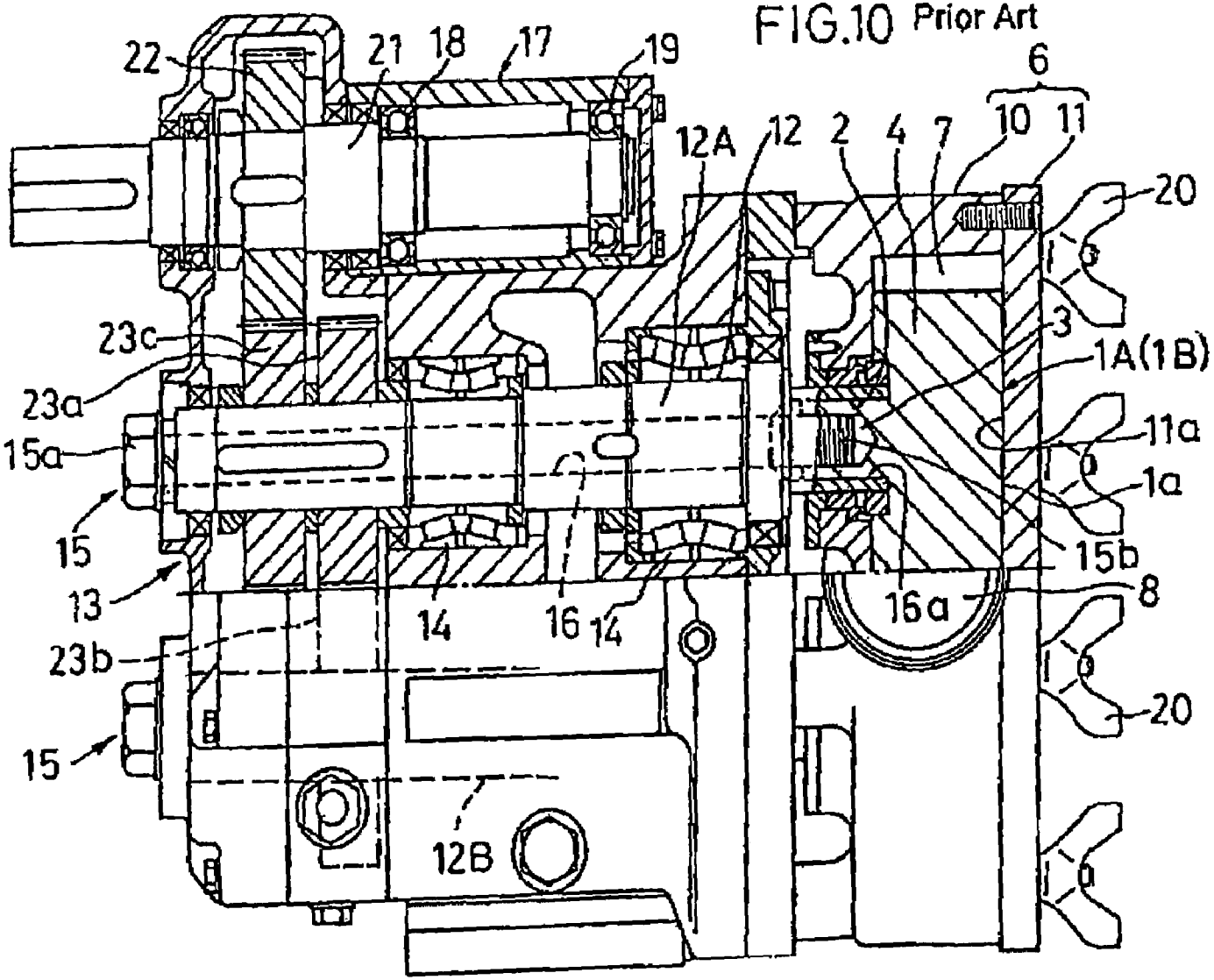
FIG.10 Prior Art
FIG. 10 (prior art) is a front view in partial cross-section of the conventional rotary pump.
Figure 11:
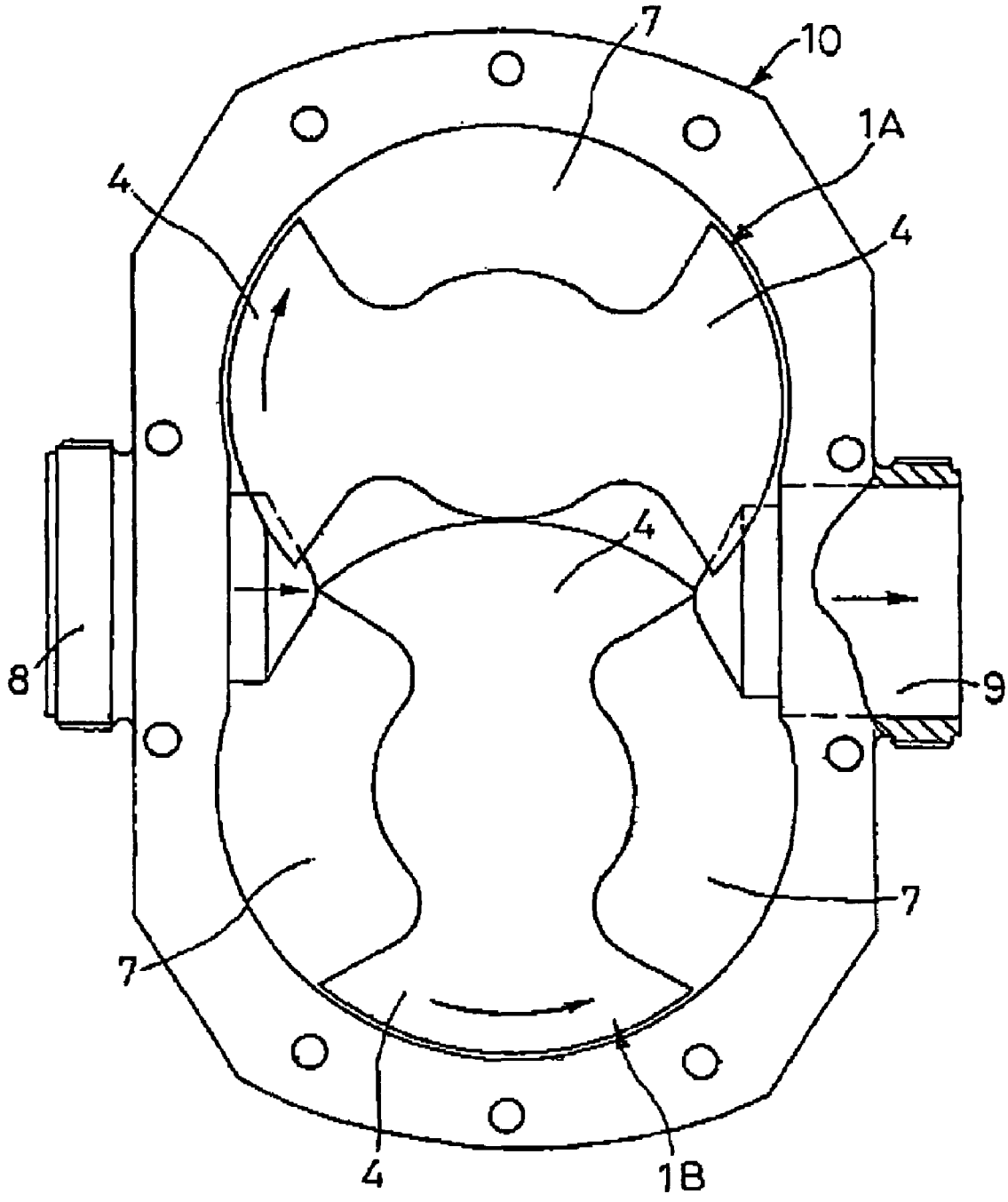
FIG.11 Prior Art
FIG. 11 (prior art) is a side elevational view of a conventional internal pump mechanism.

FIG. 1 shows one embodiment of a rotary pump according to the present invention. The construction of the rotary pump is basically very similar to the prior art shown in FIGS. 10 and 11. Namely, a pump casing 30 is constructed with a main casing 43 which define a concave pumping chamber 42 one the side of one surface for housing a pair of rotors 31A and 31B (the rotors generally identified by the reference numeral 31) which loosely engage with pumping segments 32 integrally formed with the rotors 31A and 31B for rotation therewith; the casing 30 also defines a suction port 50 and a discharge port 51 communicating with the pumping chamber 42, and a casing cover 44 detachably mounted on the main casing 43 by bolts 52 flush with the end surface of the pair of rotors 31.

Figure 3:
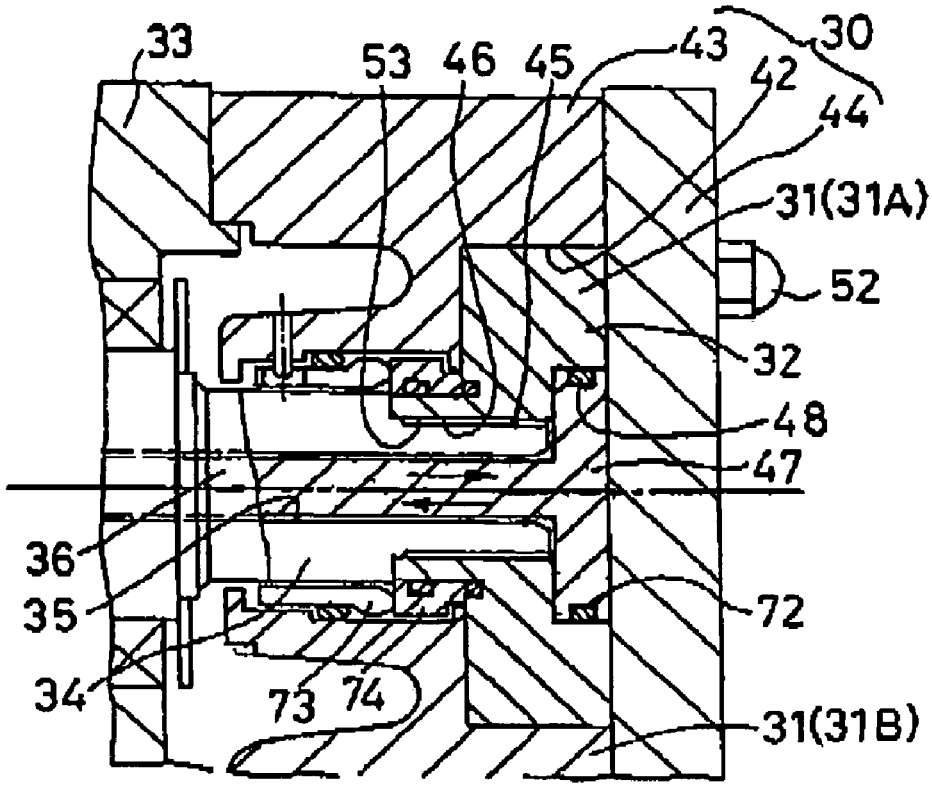
FIG. 3 is a front view in longitudinal cross-section of another major part of the first embodiment of the rotary pump.

This embodiment is similar to the prior art in that a pair of rotors 31 are mounted on hollow rotary drive shafts 34A and 34B (which are referred to generally by the reference numeral 34) by tightening a rotor fastening bolt 36 into hollow portions 35 of the rotary drive shafts 34. However, the particular mounting structure is different from the prior art. As shown in FIG. 3, in accordance with the present invention, a through opening 53 formed with an internal outer peripheral surface 46 with a spline groove and a recessed portion 48 communicating with the through opening 53, having greater diameter that the through opening 53 and an opening on the side of the casing cover 44 are respectively formed in the rotors 31. Tip ends of a pair of hollow rotor drive shafts are formed as splined shafts 45 engaging the spline of the inner periphery 46 of the through opening 53 so that the rotors 31 and the hollow rotary drive shafts 34 are integrated for rotation in accurately and coaxially aligned manner by engaging the splined shafts 45 with the through openings 53.

The rotor fastening bolt 36 is integrally formed with a flange portion 47 which engages with the recessed portion 48 formed in the rotor 31. The bolt is inserted from the side of the casing cover 44. The rotor fastening bolt 36 is then inserted into the hollow portion 35 of the hollow rotor drive shaft 34 to extend a tip end thereof from an outer end surface of the hollow rotor drive shaft and to range outwardly therefrom. A fastening nut 49 is engaged with the outward ranging tip of the rotor fastening bolt 36. By tightening the fastening nut 49 onto the rotor fastening bolt 36, the rotor 31 is drawn toward the hollow rotor drive shaft 34 to be fixed in a condition firmly abutting against an inner end surface at a tip of the hollow rotor drive shaft 34. It should be noted that in the condition where a flange 47 is received within a recessed portion 48, the flange 47 and the rotor 31 form a flush surface mating with the casing cover 44. The fastening nut 49 can be replaced with a washer to engage the washer with the rotor fastening bolt 36 and a lock nut 57 is employed as the fastening nut so that the fastening nut 57 is engaged and tightened with the rotor fastening bolt 36 through the washer to achieve a similar effect. In the alternative, a sealing member 72 such as an O ring is disposed between the flange portion 47 and the recessed portion 48, and in conjunction therewith, the flange 47 and the rotor 31 form the flash surface to be mated with casing cover 44 in the condition where the flange 47 is engaged with the recessed portion 48, as shown in FIG. 3. Mechanical seals 73 and 74 are provided for maintaining a liquid tight state between the pump chamber 42 and the outside.

Figure 4:
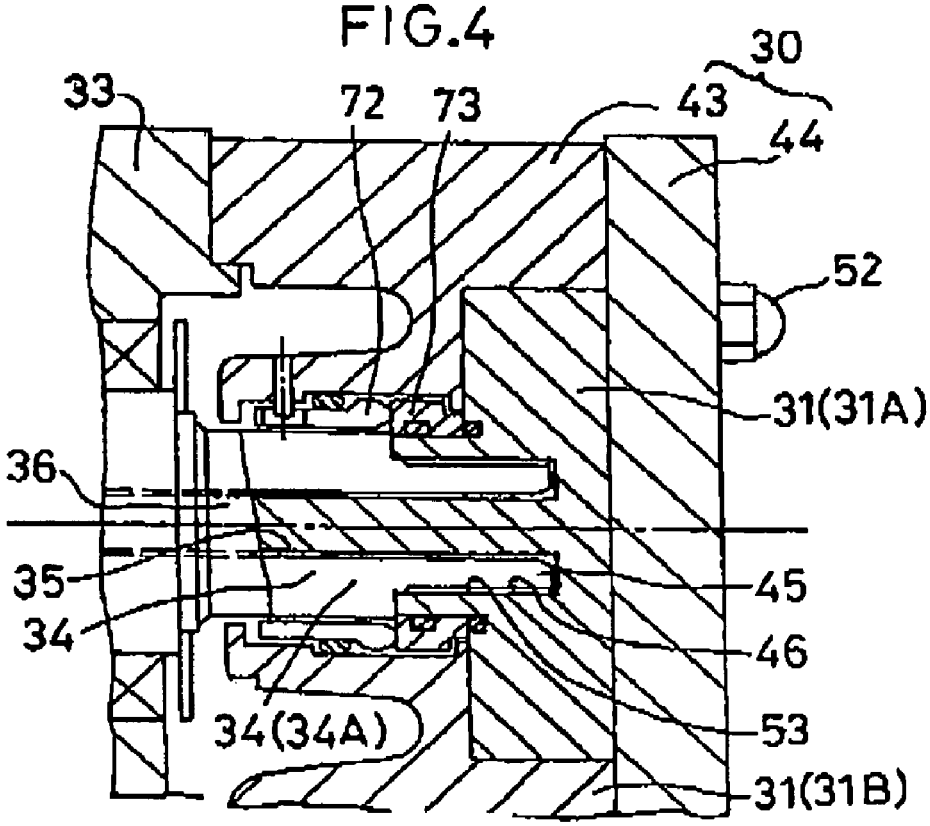
FIG. 4 is a front view in longitudinal section of another embodiment of the portion shown in FIG. 3.

On the other hand, in the embodiment shown in FIG. 3, the rotor fastening bolt 36 is provided with the flange portion 47 on the tip portion thereof to engage with the recessed portion 48 in the rotor 31. However, it is also possible to form the rotor fastening bolt 36 integrally with the rotor 31 to extend axially as shown in FIG. 4. With the embodiment shown in FIG. 4, since number of the parts can be reduced in comparison with the embodiment shown in FIG. 3, assembling can be facilitated. Furthermore, since the modification reduces possibility of retention of liquid, it is also more sanitary.

A pair of the hollow rotor drive shafts 34 (34A and 34B) are supported by bearings 55 and 56 in a gearbox 33 in a housing 54 located adjacent the pump casing 30. Within the gearbox 33, gears 37, 37 are provided for synchronous driving for respective one of the hollow rotor drive shafts 34 so that the hollow rotor drive shafts 34A and 34B are synchronously driven for rotation in mutually opposite directions.

One hollow rotor drive shaft 34A is extended from the gearbox 33 to a greater extent to form an extended drive shaft portion 39. A cylindrical frame shaped transmission coupling 41 is connected on the so extended drive shaft portion 39. This is an important feature of the present invention.

Figure 2:
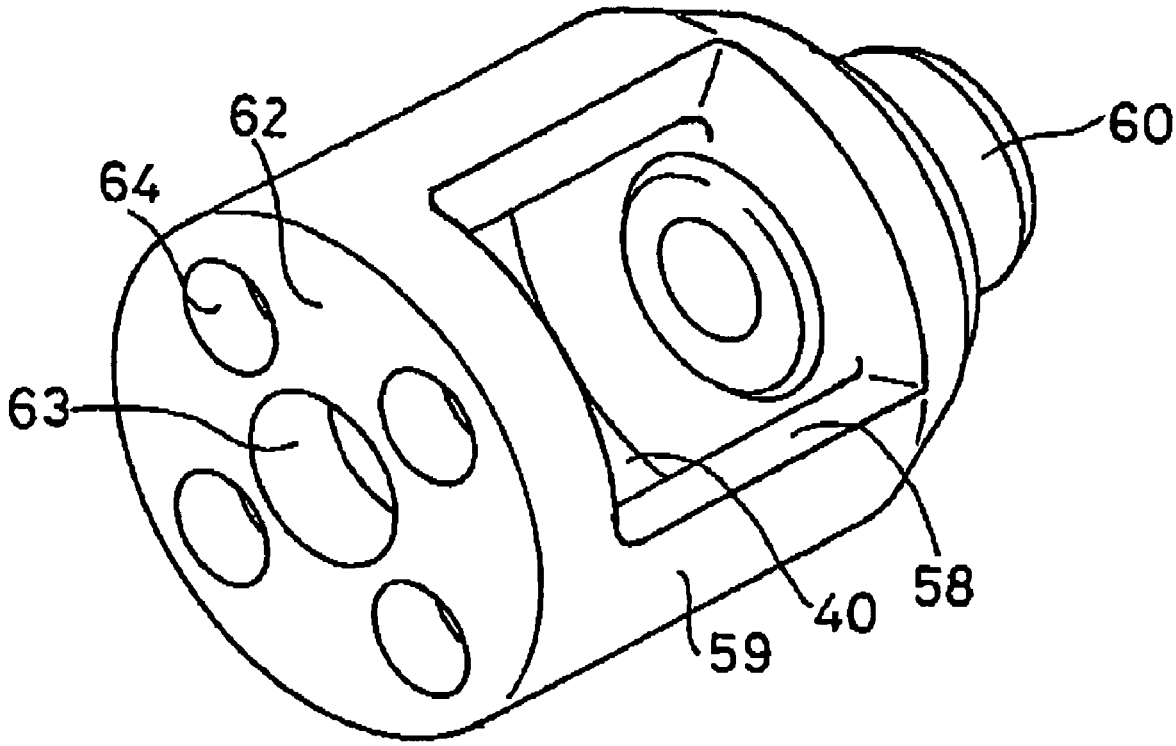
FIG. 2 is a perspective view of the major part of the first embodiment of the rotary pump.

As shown in FIG. 2, a transmission coupling 41 is formed with a cylindrical frame shaped coupling body 59 having a large operation window 58 on its circumference, a boss hole 60 projected on one end surface for connection, a connecting frame 62 for connecting a coupling 61 on the side of the other end portion of the transmission member, an operation window 63 and a connecting hole 64. After fitting a collar 65 to the extended drive shaft 39, the extended drive shaft 39 is engaged with the connecting boss hole 60 of the transmission coupling 41 to establish a key coupling with a key groove 66 and a key 67 provided between the extended drive shaft 39 and the transmission coupling 41. A connecting nut 68 is engaged and tightened on a threaded portion 39*a* on the outer periphery of the extended drive shaft 39, for coupling the extended drive shaft portion 39, and namely the hollow rotor drive shaft 34 with the transmission coupling 41 for integral rotation. On the other hand, a transmission member 69 connected on the side of the motor is connected to the transmission coupling 41 through the coupling on the side of the transmission member by a bolt and nut 70, with the connecting hole 64 of the connecting frame 62 being engaged with the bolt and nut 70 and a buffering connecting member 71 engaged with the connecting hole 64. As it becomes clear from the foregoing description, the fastening nut 49 and the lock nut 57 are normally tightened with the rotor fastening bolt 36 after mounting the transmission coupling 41.

Upon driving the rotary pump of the present invention, the rotational force of the transmission member 69 connected on the side of the motor is transmitted to the transmission coupling 41 through a coupling 61 on the side of the transmission member. The transmission coupling 41 drives the hollow rotor drive shaft 34A on one end which is connected directly to the coupling 41, and drives the other hollow rotor drive shaft 34B through a pair of synchronous driving gears 37 and 38. By this, the pair of rotors 31 are synchronously rotated in mutually opposite directions.

Since the main casing 43 and the casing cover 44 are firmly fitted with each other in face-to-face contact, during rotation of the rotors the transported liquid may not be retained in this portion to keep the rotary motor in sanitary state. Upon disassembly, in the condition where the transmission coupling 41 is mounted on the hollow rotor drive shaft 34, an operator can insert a rotary tool, such as spanner, screw driver or the like into an operation space 40 through the operating window 58 or 63 to easily disengage the fastening nut 49 and the lock nut 57 which are engaged with the rotor fastening bolt 36 within the operation space 40. Then, by loosening the bolts 52, the casing cover 44 is disassembled from the main casing 43. Thus, the rotor 31 and the rotor fastening bolt 36 as assembled or integrated as in the embodiment shown in FIG. 4 can be withdrawn to the outside of the main casing 43. Therefore, the pumping chamber 42 can be easily disassembled for performing cleaning operation.

Upon assembling, the rotor drive shaft 34 is inserted into the through opening 53 in such a manner that the splined coupling shaft 45 of the rotor drive shaft 34 is engaged with spline surface of the rotor 31. The rotor fastening bolt 36 is then inserted into the hollow portion 35 of the hollow 20 rotor drive shaft 34 from the side of the casing cover 44. At the rear end, the operator tightens the fastening nut (washer) 49 and the lock nut 57 (fastening nut) onto the rotor fastening bolt 36 within the operation space 40 through the operation window 58 or 63. Thus, the rotary pump can be easily assembled.

With the foregoing embodiment, the splined coupling shaft 45 at the tip end portion of the hollow rotor drive shaft is engaged with the spline surface on the inner periphery of the through opening 53 of the rotor 31, and the hollow rotor drive shaft 34 and the rotor 31 are rigidly secured with each other by the rotor fastening bolt 36. Therefore, no slip will occur therebetween, thus to assure integral rotation. Furthermore, concentric relationship between the rotor and the hollow rotor drive shaft can be maintained for a long period.

FIGS. 5 to 9 show another embodiment of the rotary pump according to the present invention. It should be noted that, in the following disclosure, components common to the former embodiment of FIGS. 1 to 4, will be identified by the same reference numerals, and detailed discussion for such common components will be omitted in order to avoid redundant discussion and whereby to keep the disclosure simple enough to facilitate clear understanding of the present invention. Therefore, the following disclosure will be concentrated to the particular construction of the illustrated embodiment.

Figure 5:
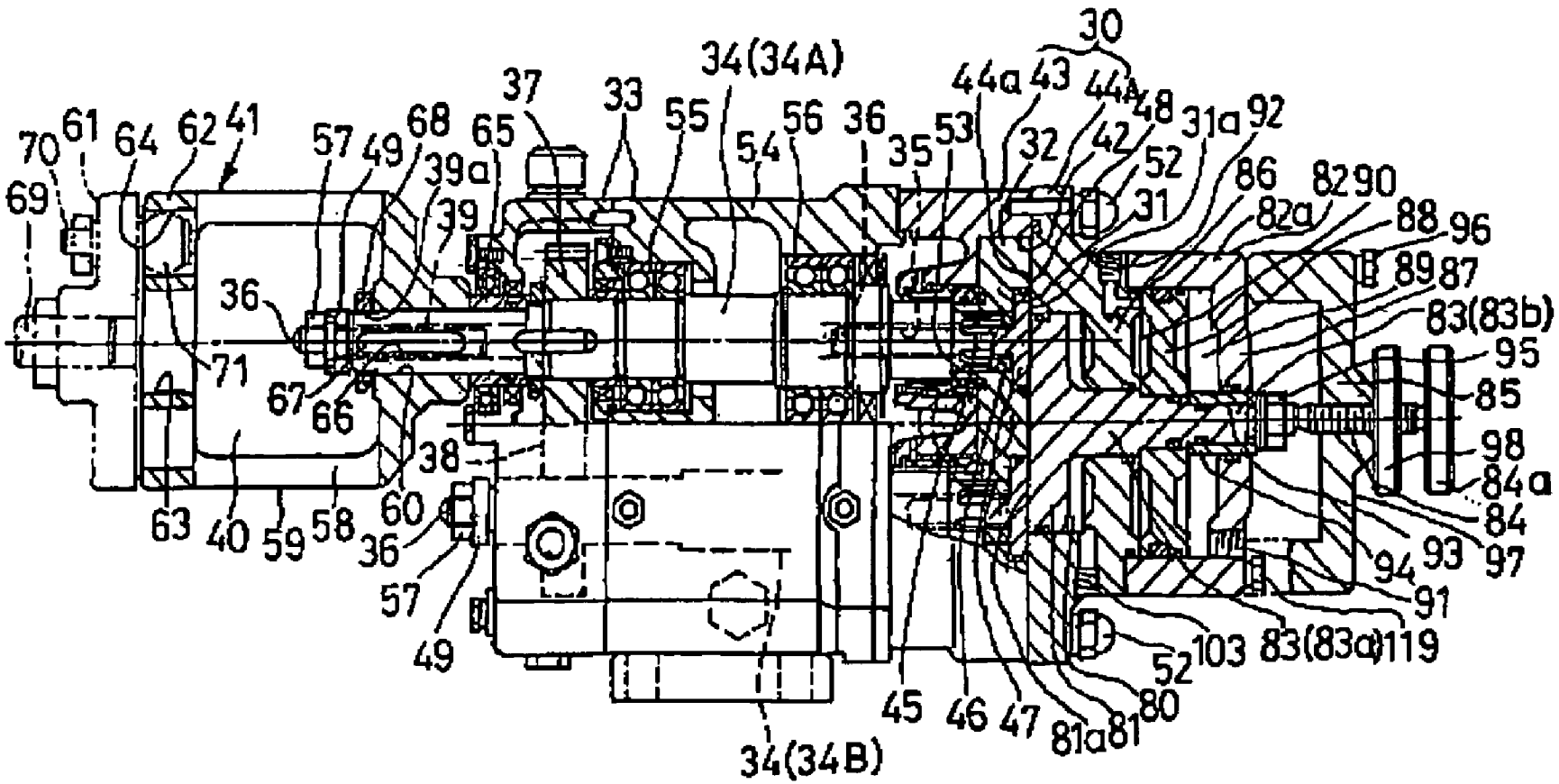
FIG. 5 is a front view in partial cross-section of another embodiment of the rotor according to the present invention.

As shown in FIG. 5, a space 80 having a given width in a thickness direction of a casing cover 44A is defined at the center portion of the casing cover 44A with the end surface 31*a* of the rotor 31 by forming a recess on the surface of the casing cover 44A mating with the end surface 31*a* of the rotor 31. A cover piston 81 is engaged with the peripheral wall defining the space 80 in gas tight fashion for reciprocal motion in the thickness direction, namely toward and away from the end surface 31*a* the rotor 31. An air cylinder 82 is mounted on the casing cover 44A in coaxial relationship with the cover piston 81 by mounting bolts 83. The air cylinder 82 is constructed with a cylinder body 82*a*, a cylinder cover 86 located on the side of the casing cover 44A, a cylinder cover 87 on the opposite side, a piston 88 slidingly reciprocating within the cylinder body 82*a* a piston rods 83*a* and 83*b* (which will be identified by reference numeral 83 as generally referred to) extending from both sides of the piston 88, and inlet/outlet ports 91 and 92 communicated with forward drive side and reverse drive side cylinder chambers 89 and 90 defined on both sides of the piston 88. The cylinder cover 86 on the side of the casing cover 44A may be formed to be common with the casing cover 44A. Also, the cylinder cover 86 can be provided separately on the side of the air cylinder 82. In this case, the space 80 of the casing cover 44A is formed through the casing cover 44A. On the other hand, the cylinder cover 86 formed separately on the side of the air cylinder 82 can serve as the casing cover 44A and the cylinder cover 86 and the casing cover can be formed integrally with each other. In this case, the cylinder cover 86 of the air cylinder is mounted directly on the main casing 43 as the casing cover 44A by the bolts.

The end surface 81*a* on the side of the rotor 31 of the cover piston 81 is mated with the inner end surface 44*a* of the casing cover 44A for tightly fitting with each other. On the other hand, the end surface 81*a* of the rotor 31 is substantially in contact with the end surface 31*a* of the rotor 31 with maintaining a fine gap therebetween. The piston rod 83*a* extended from the piston 88 of the air cylinder 82 toward the casing cover 44A is integrally connected to the cover piston 81 through the cylinder cover 86. The piston rod 83*b* projecting from the piston toward the opposite side is extended externally through the other cylinder cover 87. More accurately, the piston rod 83*b* is formed with a collar 94 engaging a small diameter portion 93 and a nut 95 threadingly engaged with a threaded portion at the tip end of the small diameter portion in order to secure the collar 94.

A lock cylinder 85 is coaxially mounted to the air cylinder 82, as shown in FIG. 5. A lock bolt 84 is threadingly engaged with the lock cylinder 83. The lock bolt may abut against a tip end surface of the piston rod 83*b* of the air cylinder 82 and is movable back and forth along the motion direction of the piston rod 83*b*. A lock nut 46 is threadingly engaged on the lock bolt 84, for locking the lock bolt 84 at a predetermined position. The lock cylinder 85 is not limited to a cylindrical shape but can be any appropriate shape. The lock cylinder is only required to be any appropriate shape of the frame body, to which the lock bolt 84 is threadingly engaged for a back and forth linear motion. On the other hand, while this embodiment employs the piston rod 83*b* of the air cylinder to extend outwardly through the cylinder cover 87, it is also possible to engage the lock bolt 84 with the cylinder chamber 89 from the cylinder cover 87 to abut the tip end portion of the lock bolt onto the piston 88 instead of providing the piston rod 83*b*.

Figure 6:
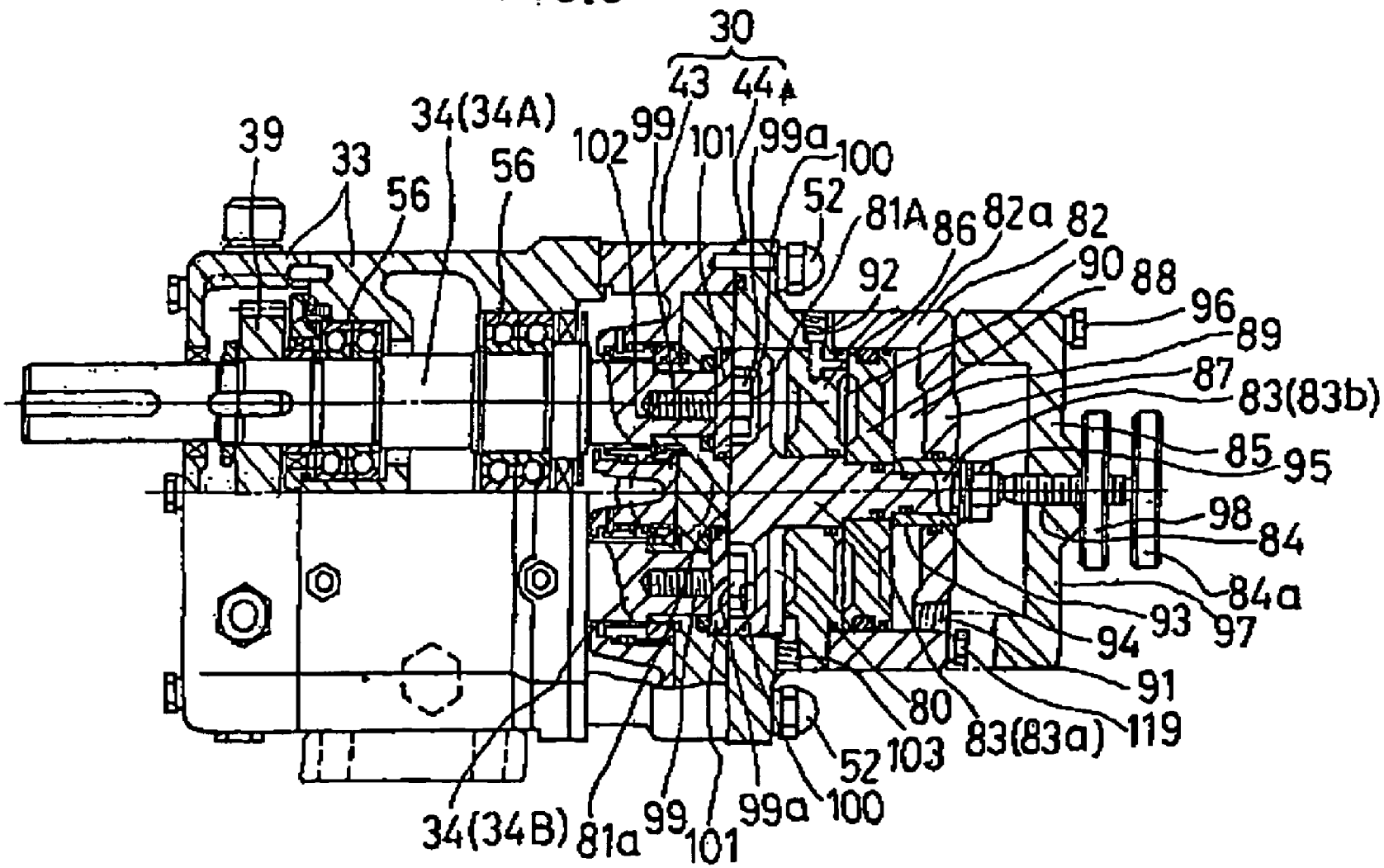
FIG. 6 is a front view in partial cross-section of slight modification of the embodiment shown in FIG. 5.

FIG. 6 shows a modification of another embodiment of the rotary pump, in which the shape of the cover piston 81A is to be engaged with the space 80 in gas tight fashion. In the embodiment shown in FIG. 5 is an end surface 81*a* at one side of the rotor of the cover piston 81. In contrast to this, the present embodiment of the invention as shown in FIG. 6 has the cover piston 81A, in which a head portion 99*a* of the bolt 99 is projected from the rotor 31. Therefore, a recessed portion 100 is provided for, in which a head portion 99*a* of the bolt 99 is projected from the rotor 31. Therefore, a recessed portion 100 is provided for receiving the head portion 99*a* of the bolt 99. In this construction of the rotary pump, a rotor drive shaft 34 (34A 34B) is engaged at the center portion of the rotor 21 for mounting the rotor 31 on the rotor drive shaft 34. Across a stopper plate 101, the bolt 99 is threadingly engaged with the threaded hole 102 provided on the end surface of the rotor drive shaft 34. Thus, the rotor 31 is mounted on the rotor drive shaft.

Except for the shape of the cover piston 81, the modification of FIG. 6 has the same construction as the former embodiment. The common components have been omitted from the detailed discussion to avoid redundant discussion and to keep the disclosure simple enough to facilitate clear understanding of the present invention.

With the construction of FIG. 6, upon operating the rotary pump in the normal state, as shown in FIG, 5 or 6, an air is supplied into the forward side cylinder chamber 89 through the inlet port of the air cylinder 82 to actuate the piston 88 in forward direction, i.e. toward left in the drawing. By this, the cover pistons 81 and 81A are placed flush with the inner end surface of the casing cover 44A and substantially in contact with the minimum fine gap between the end surface 31*a* of the rotor 31 It should be noted when the piston 88 is moved toward left in the drawing, air in the left side reverse side cylinder chamber 90 is supplied (charged/discharged) through the port 92.

Upon automatic operation by the air cylinder 82, the lock bolt 84 of the lock cylinder 85 is retracted from the tip end surface of the piston rod 83*b* at the right side of the air cylinder 82 in the drawing. During operation of the rotary pump, the lock bolt 84 of the lock cylinder 85 can be kept in contact with the tip end surface of the piston rod 83 to prevent the cover pistons 81 and 81A from being retracted from the end surface 31*a* of the piston to reduce pumping effect even when the internal pressure of the pumping chamber 42 is elevated to be higher than or equal to a predetermined pressure to overcome the biasing force of the piston 88 of the air cylinder 82.

Figure 7:
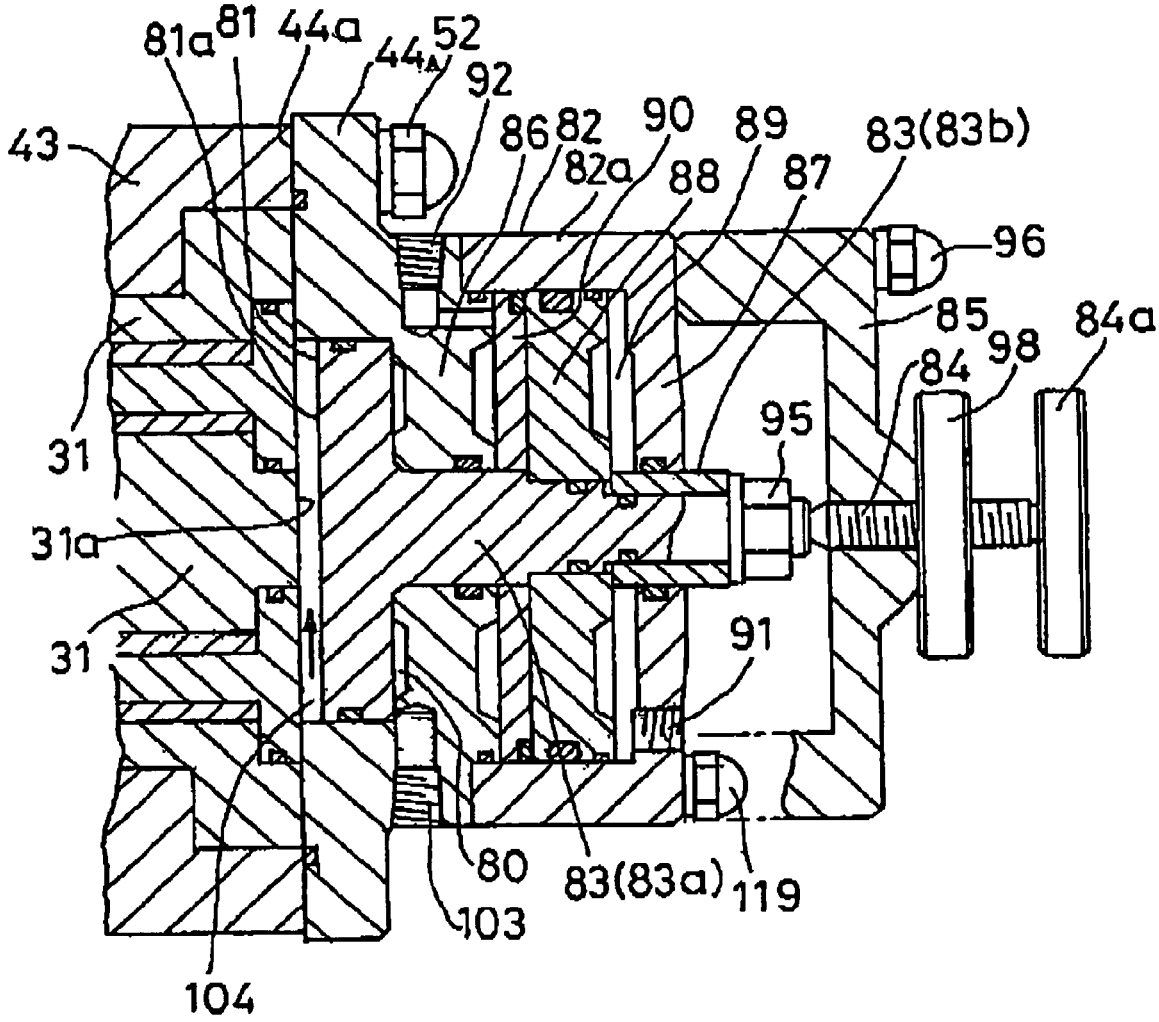
FIG. 7 is a front view in cross-section showing operating condition of the major part of the embodiment shown in FIG. 5.
Figure 8:
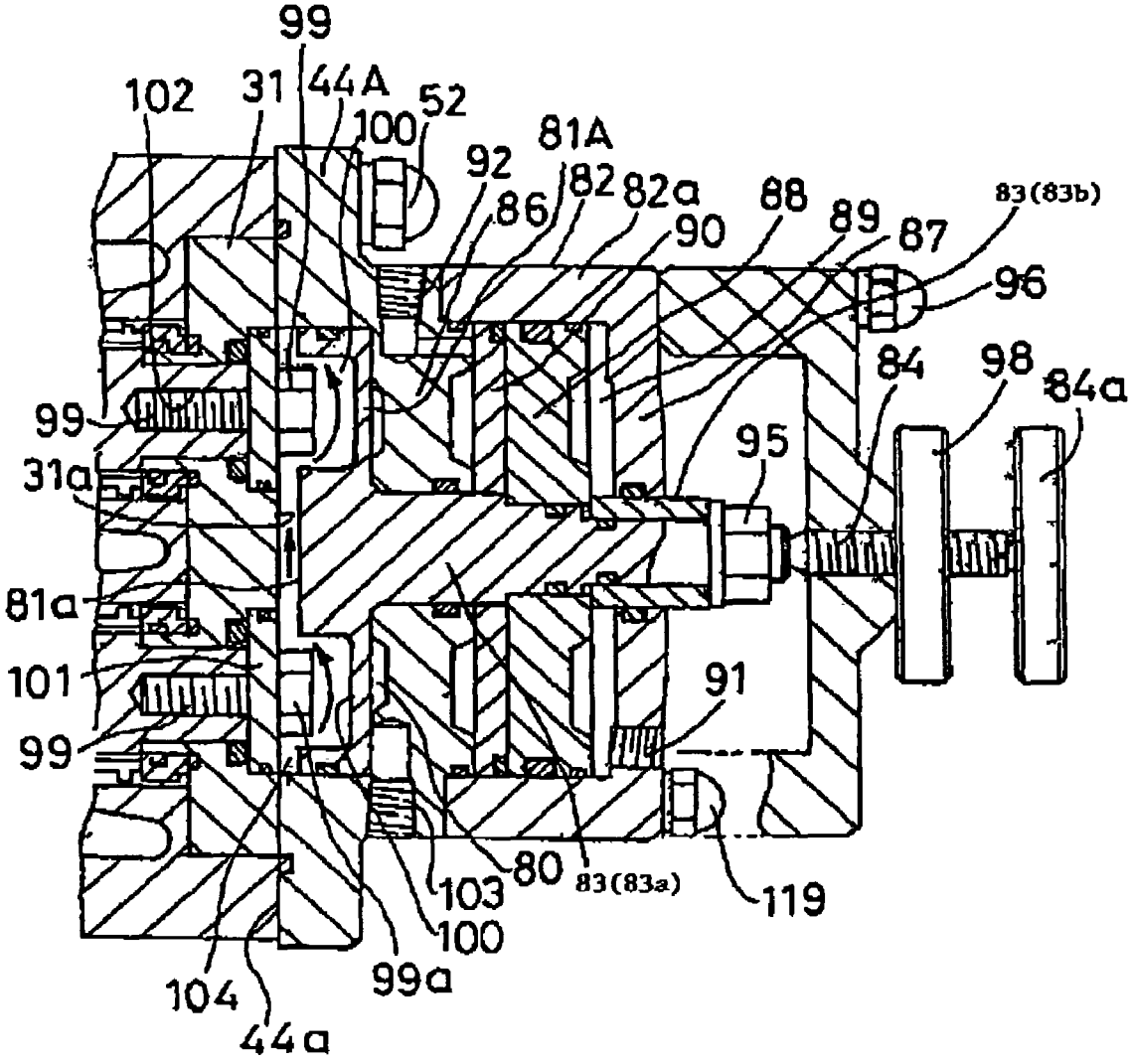
FIG. 8 is a front view in longitudinal cross-section showing the operating condition of the major part of the embodiment shown in FIG. 6.

Upon washing the pumping chamber 42 at the end of operation of the pump for a day, a gripping portion of the lock bolt 42 is operated to retract the lock bolt 84 from the tip end surface of the piston rod 83 and also, the air is introduced into the reverse side cylinder chamber 90 under pressure and the air in the cylinder chamber 89 on the opposite side is supplied (charged/discharged) trough the port 92, and in conjunction therewith the air in the space 80 defined by the casing cover 44 and the cover piston 81 is discharged through an air discharge opening 103. By this, as shown in FIG. 7 or FIG. 8, the piston 88 is moved toward right in the drawing. By this, the cover pistons 81 and 81A connected to the piston rod 83*a* are retracted away from the end surface 31*a* of the rotor 31 to define a large gap 104 between the cover piston 81 and 81A and the end surface of the rotor 31. By feeding the washing water into the pumping chamber 42, large amount of the washing water will flow as shown by arrow and discharged through the discharge port 51. Larger amount and higher flow velocity will result in higher washing effect to effectively improve the washing effect for the pumping chamber 42, particularly the end surface 31*a* of the rotor 31 and the inner end surface 44*a* of the casing cover 44 opposed to the end surface 31*a*.

It should be noted that during washing operation, the rotor 31 can be rotated at low speed or held stopped. The washing water is preferably fed by a dedicated pump for the washing water. In this case, it is advantageous to make the bypass piping for feeding the washing water unnecessary in the rotary pump.

On the other hand, in case of manual operation, it is possible not to use the air cylinder with maintaining the inlet and outlet port in free condition and use only lock cylinder to maintain the cover pistons 81 and 81A in flush with the casing cover 44A by the contact pressure for the piston rod 83*b* of only the lock bolt 84. In this case, while the lock cylinder 85 is mounted on the casing cover 44A through the air cylinder 82, it is also possible to omit the air cylinder to directly secure the lock cylinder 85 onto the casing cover 44A by means of bolts to abut the lock bolt 84 of the lock cylinder 85 to the portion projecting from the casing cover 44A (rod portion 83*a*).

Then, upon washing, the lock bolt 84 is retracted from the tip end surface of the piston rod 83*b*. In this condition, the washing water is fed into the pumping chamber to push the cover piston 81 away from the end surface 31*a* of the rotor 31 by the water pressure to form the large gap 104 therebetween to effectively flow through a large amount of washing water to improve the washing effect.

On the other hand, as set forth above, by retracting the lock bolt 84 of the lock cylinder 85 away from the tip end surface of the piston rod 83*b* on the right side of the air cylinder in the drawing, it becomes possible to provide vented (relief) cover function for the cover pistons 81 and 81A so that the pump discharge pressure of the rotary pump can be adjusted not to be elevated beyond a given pressure during automatic operation by the air cylinder.

By constantly supplying a given pressure of air through the port 91 of the air cylinder 82, the cover pistons 81 and 81A are placed in opposition to the pumping action position of the end surface 31*a* of the rotor 31 by the piston 88 biased by the air pressure. When the discharge pressure of the pump is elevated beyond the given pressure to buildup a pressure to retract the cover pistons 81 and 81A away from the end surface 31*a* of the rotor 31 thus overcoming the biasing pressure of the piston 88, the cover piston 81 is retracted from the end surface 31*a* of the rotor 31 to lower pumping function and relieve the discharge pressure. The discharge pressure of the rotary pump can be regulated by this. The discharge pressure can be freely set by the air pressure to be supplied into the air cylinder.

Figure 9:
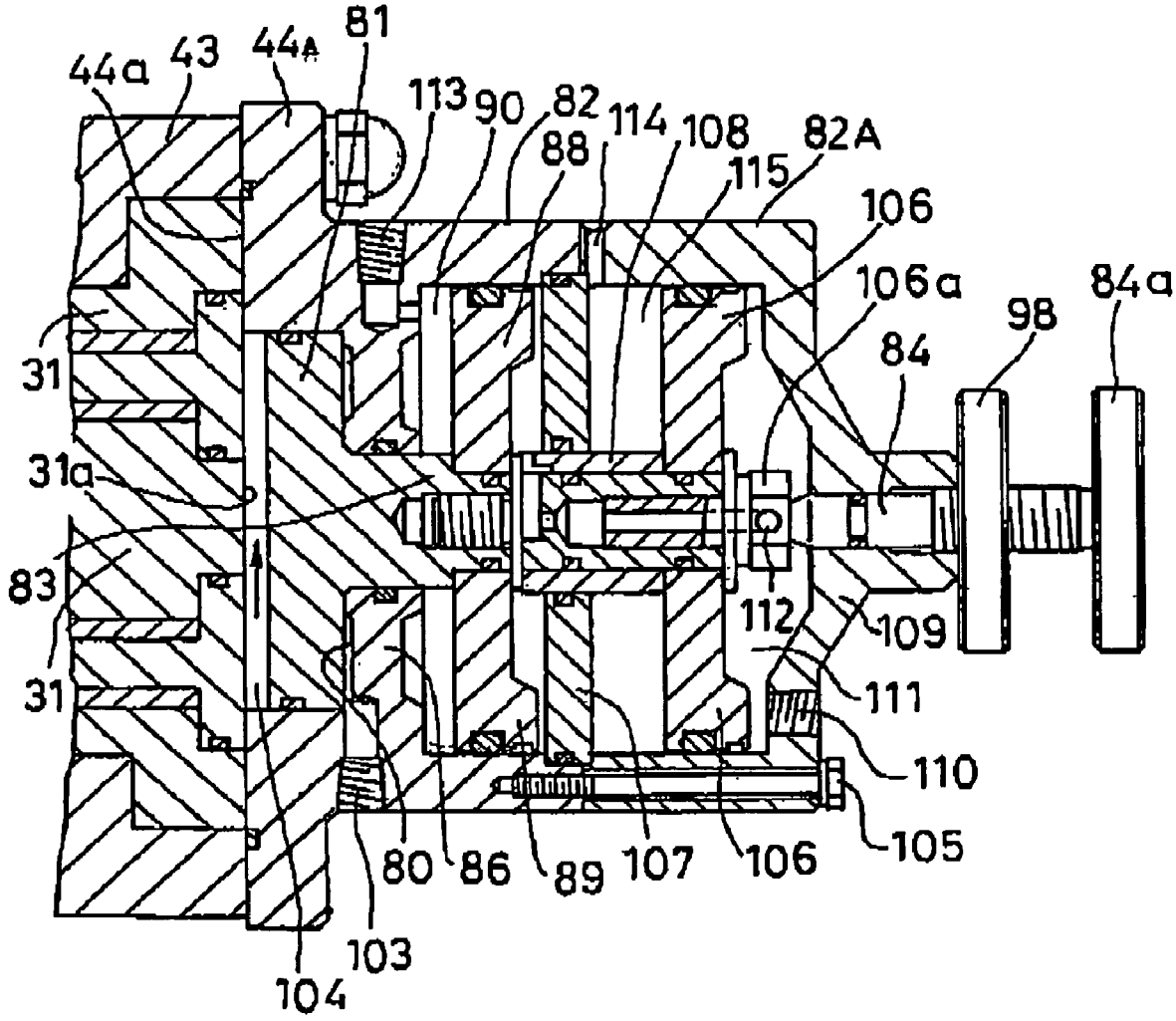
FIG. 9 is a front view in longitudinal cross-section showing the operating condition of the major part of another embodiment shown in FIG. 6.

FIG. 9 shows a further embodiment of the rotary pump according to the present invention. In the former embodiment, only one air cylinder 82 is provided. In contrast to this, the embodiment 82A of FIG. 9 is provided with another air cylinder mounted by bolts 105, in addition to the air cylinder 82. Respective pistons 88 and 106 are connected to piston rod 108 extending through a common cylinder cover 107. The lock bolt 84 is threadingly engaged with the cylinder cover 109 of the later air cylinder 82. In the embodiment of FIG. 9, two air cylinders 82 and 82A are connected with each other. However, more than two air cylinders can be employed. On the other hand, in the embodiment 82A of FIG. 9, the lock bolt 84 is threadingly engaged with the rearmost air cylinder. It is also possible to mount the air 10 cylinder 82A at the rearmost position, to threadingly engage the lock bolt 84 and to contact the lock bolt onto the piston or the piston rod as shown in FIGS. 5 and 6.

In the embodiment 82A of FIG. 9, by introducing air from an inlet portion 110 of the later air cylinder 82A into the forward cylinder chamber 111 under pressure, the air is supplied to the forward cylinder 89 of another air cylinder through a through hole 112 provided in the piston rod 108 to push the pistons 88 and 106 of both air cylinders 82 and 82A simultaneously. Therefore, the cover pistons 81 and 81A are held by both pistons 88 and 106 to maintain the cover pistons 81 and 81A at the position opposing to the pumping action position of the end surface 31*a* of the rotor 31 at greater force. At this time, as discussed above, the cover piston 81 and 81A are held at predetermined action position by the lock bolt 84 as required. Inlet and outlet ports 113 and 114 provided in reverse side cylinder chambers 90 and 115 of both air cylinders 82, and a ventilation aperture 103 is provided in the space 80.

Although the present invention has been illustrated and described with respect to exemplary embodiments thereof, it should be understood by those skilled in the art that the foregoing and various changes, omission and additions can be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the features set out in the appended claims.

I claim:

1. A rotary pump, comprising:

a main casing;

a casing cover cooperated with said main casing for defining a pumping chamber there between;

a pair of rotors received within said pumping chamber with mutually meshing pumping segments for synchronous revolution in mutually opposite directions;

a space being defined in one portion of said casing cover;

a cover piston being disposed within said space for movement back and forth with respect to an end surface of said rotor and being connected to one end surface of a piston rod of an air cylinder;

said air cylinder being mounted on said casing cover and comprising a piston;

at least one port being communicated with forward drive side and reverse drive side cylinder chambers and defined on both sides of the said piston of said air cylinder.

2. A rotary pump, comprising:

a main casing;

a casing cover cooperated with said main casing for defining a pumping chamber there between;

a pair of rotors received within said pumping chamber with mutually meshing pumping segments for synchronous revolution in mutually opposite directions;

a space being defined in one portion of said casing cover;

a cover piston being disposed within said space for movement back and forth with respect to an end surface of said rotor and being connected to one end surface of a piston rod of an air cylinder;

said air cylinder being mounted on said casing cover and comprising a piston;

at least one port being communicated with forward drive side and reverse drive side cylinder chambers and defined on both sides of the said piston of said air cylinder a lock cylinder having a lock bolt being mounted on said air cylinder;

the other end surface of said piston rod of said air cylinder being abutted to said lock bolt for restricting movement of said cover piston by said lock bolt.

* * * * *